US011882869B2

(12) United States Patent
Hwang et al.

(10) Patent No.: US 11,882,869 B2
(45) Date of Patent: Jan. 30, 2024

(54) CIGARETTE WITH OUTER WRAPPER

(71) Applicant: KT&G CORPORATION, Daejeon (KR)

(72) Inventors: Jung Seop Hwang, Daejeon (KR); Dong Kyun Ko, Sejong (KR); Jae Sung Noh, Cheonan-si (KR); Bong Su Cheong, Daejeon (KR); Sang Won Choi, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 788 days.

(21) Appl. No.: 16/965,749

(22) PCT Filed: Nov. 12, 2019

(86) PCT No.: PCT/KR2019/015328
§ 371 (c)(1),
(2) Date: Jul. 29, 2020

(87) PCT Pub. No.: WO2020/105930
PCT Pub. Date: May 28, 2020

(65) Prior Publication Data

US 2021/0030056 A1 Feb. 4, 2021

(30) Foreign Application Priority Data

Nov. 23, 2018 (KR) ..... 10-2018-0146475

(51) Int. Cl.
*A24D 1/20* (2020.01)
*A24D 1/02* (2006.01)
(Continued)

(52) U.S. Cl.
CPC ..... *A24D 1/20* (2020.01); *A24D 1/02* (2013.01); *A24D 3/17* (2020.01); *D21H 17/15* (2013.01); *D21H 21/14* (2013.01); *D21H 27/00* (2013.01)

(58) Field of Classification Search
USPC ..... 131/331; 162/139
See application file for complete search history.

(56) References Cited

U.S. PATENT DOCUMENTS 5,692,526 A 12/1997 Adams et al.
6,615,840 B1 9/2003 Fournier et al.
(Continued)

FOREIGN PATENT DOCUMENTS

CN 102014676 A 4/2011
CN 103561600 A 2/2014
(Continued)

OTHER PUBLICATIONS

Machine translation of KR 1020180111460 A, WIPO Patentscope, [online], retrieved from the internet, [retrieved May 17, 2023], <URL: https://patentscope.wipo.int/search/en/search.jsf> (Year: 2023).*
(Continued)

*Primary Examiner* — Dennis R Cordray
(74) *Attorney, Agent, or Firm* — Sughrue Mion, PLLC

(57) ABSTRACT

A cigarette according to an embodiment may include a cigarette rod including an aerosol-generating material; a filter rod located at one end of the cigarette rod and including a first segment and a second segment; a front end plug located at the other end of the cigarette rod; and an outer wrapper wrapping the cigarette rod, the filter rod and the front end plug, wherein the outer wrapper has a basis weight of 57 g/m$^2$ to 63 g/m$^2$ and a thickness of 64 μm to 70 μm to increase the strength of the cigarette.

7 Claims, 5 Drawing Sheets

(51) Int. Cl.

| | |
|---|---|
| ***A24D 3/17*** | (2020.01) |
| ***D21H 27/00*** | (2006.01) |
| ***D21H 17/15*** | (2006.01) |
| ***D21H 21/14*** | (2006.01) |

(56) References Cited

U.S. PATENT DOCUMENTS

| | | | | |
|---|---|---|---|---|
| 8,042,551 | B2 | 10/2011 | Tabuchi et al. | |
| 10,357,057 | B2 | 7/2019 | Kadiric | |
| 2005/0211259 | A1* | 9/2005 | Gedevanishvili ..... | B82Y 30/00 131/365 |
| 2009/0084392 | A1 | 4/2009 | Fiebelkorn | |
| 2011/0155156 | A1 | 6/2011 | Hooper et al. | |
| 2012/0305015 | A1 | 12/2012 | Sebastian et al. | |
| 2014/0238427 | A1 | 8/2014 | Tanasheva et al. | |
| 2016/0316816 | A1 | 11/2016 | Lavanchy et al. | |
| 2016/0331031 | A1 | 11/2016 | Malgat et al. | |
| 2017/0049147 | A1 | 2/2017 | Binassi et al. | |
| 2020/0154776 | A1 | 5/2020 | Lee et al. | |
| 2020/0359682 | A1 | 11/2020 | Han et al. | |
| 2021/0045435 | A1 | 2/2021 | Kuersteiner et al. | |
| 2021/0106051 | A1 | 4/2021 | Han et al. | |

FOREIGN PATENT DOCUMENTS

| | | | |
|---|---|---|---|
| CN | 104540402 | A | 4/2015 |
| CN | 105357993 | A | 2/2016 |
| CN | 207836767 | U | 9/2018 |
| EP | 3 556 230 | A2 | 10/2019 |
| EP | 3 818 869 | A1 | 5/2021 |
| EP | 3 818 872 | A1 | 5/2021 |
| JP | 2005-517421 | A | 6/2005 |
| KR | 10-2006-0031173 | A | 4/2006 |
| KR | 10-0615467 | B1 | 8/2006 |
| KR | 10-2008-0027790 | A | 3/2008 |
| KR | 10-2010-0121539 | A | 11/2010 |
| KR | 10-2016-0096590 | A | 8/2016 |
| KR | 10-2016-0103981 | A | 9/2016 |
| KR | 10-2016-0124091 | A | 10/2016 |
| KR | 10-2018-0111460 | A | 10/2018 |
| WO | 2018/110834 | A2 | 6/2018 |
| WO | 2018/182322 | A1 | 10/2018 |

OTHER PUBLICATIONS

Communication dated Sep. 28, 2021 from the China National Intellectual Property Administration in CN Application No. 201980008858.3.

Extended European Search Report dated Dec. 8, 2021 from the European Patent Office in EP Application No. 19886143.7.

International Search Report of PCT/KR2019/015328 dated Feb. 20, 2020 [PCT/ISA/210].

Communication dated Mar. 25, 2021 from the Korean Intellectual Property Office in Application No. 10-2018-146475.

Communication dated Jun. 8, 2021 from the Japanese Patent Office in Application No. 2020-541501.

* cited by examiner

CIGARETTE WITH OUTER WRAPPER

CROSS REFERENCE TO RELATED APPLICATIONS

This application is a National Stage of International Application No. PCT/KR2019/015328, filed Nov. 12, 2019, claiming priority to Korean Patent Application No. 10-2018-0146475, filed Nov. 23, 2018.

TECHNICAL FIELD

Embodiments relate to a cigarette including an outer wrapper, and more particularly, to a cigarette including an outer wrapper that wraps the entirety of a cigarette rod, a filter rod, and a front end plug that are components of the cigarette and increases strength of the cigarette.

BACKGROUND ART

Recently, the demand for alternative methods to overcome shortcomings of traditional cigarettes has increased. For example, there is growing demand for a method of generating an aerosol by heating an aerosol generating material in cigarettes, rather than by combusting cigarettes. Accordingly, research on a heating type cigarette and a heating type aerosol-generating device has been actively conducted.

In the case of an externally heated cigarette, in which heat generated from a heat source located outside the cigarette is transferred to the inside of the cigarette to form the aerosol, when the externally heated cigarette gets inserted into an aerosol-generating device, the cigarette is easily damaged and cut by external force because of its low strength.

Accordingly, there is a need for a cigarette having sufficient strength to maintain its shape without being damaged or wrinkled by stress and frictional force occurring while the cigarette is used by the user or inserted into the aerosol-generating device.

In addition, when heat generated from an external heat source is transferred to the inside of the cigarette, the heat is transferred to the inside of the cigarette through an outer wrapper, which absorbs the transferred heat. As a result, a rate of heat transfer to the inside of the cigarette may be reduced. As the heat transfer rate for the heat transferred to the inside of the cigarette decreases, the cigarette may not generating aerosol smoothly.

Accordingly, there is a need for a cigarette whose strength is increased to prevent the cigarette from being damaged or cut, and which allows heat generated from an external heat source to be smoothly transferred to the inside of the cigarette in order for the cigarette to effectively produce aerosol.

DESCRIPTION OF EMBODIMENTS

Technical Problem

Embodiments provide a cigarette including an outer wrapper.

The technical problems to be solved by the present embodiments are not limited to the technical problems as described above, and other technical problems may be inferred from the following embodiments.

Solution to Problem

A cigarette according to an embodiment may include a cigarette rod including an aerosol-generating material; a filter rod located at one end of the cigarette rod and including a first segment and a second segment; a front end plug located at the other end of the cigarette rod; and an outer wrapper wrapping the cigarette rod, the filter rod and the front end plug, wherein the outer wrapper has a basis weight of 57 g/m$^2$ to 63 g/m$^2$ and a thickness of 64 μm to 70 μm to increase strength of the cigarette.

The outer wrapper may have a tensile strength of 8.0 kgf/15 mm to 11.0 kgf/15 mm.

The cigarette may further include at least one of a first wrapper wrapping the front end plug, a second wrapper wrapping the cigarette rod, a third wrapper wrapping the first segment, and a fourth wrapper wrapping the second segment, wherein a basis weight of the second wrapper may be lower than a basis weight of the outer wrapper.

A porosity of the second wrapper may be higher than a porosity of the outer wrapper.

The porosity of the second wrapper may be 20000 cu to 40000 cu.

A coating material is applied to at least one of an inner and an outer surface of the second wrapper such that a heat transfer rate for the heat transferred to the cigarette rod through the second wrapper is improved.

The coating material may include at least one of sodium-citrate (Na-citrate) and potassium-citrate (K-citrate).

An applied content of the coating material may be 1% to 3%.

Advantageous Effects of Disclosure

A coating material may be applied to an outer surface facing an outer wrapper or an inner surface facing a cigarette rod, or both the inner surface and the outer surface, among surfaces of a second wrapper.

The coating material may include at least one of sodium-citrate and potassium-citrate. The above-described coating material may serve to increase heat transfer efficiency of heat transferred to a cigarette rod located inside the second wrapper.

BEST MODE

A cigarette according to an embodiment may include a cigarette rod including an aerosol-generating material; a filter rod located at one end of the cigarette rod and including a first segment and a second segment; a front end plug located at the other end of the cigarette rod; and an outer wrapper wrapping the cigarette rod, the filter rod and the front end plug, wherein the outer wrapper has a basis weight of 57 g/m$^2$ to 63 g/m$^2$ and a thickness of 64 μm to 70 μm to increase strength of the cigarette.

MODE OF DISCLOSURE

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present invention are described in detail with reference to the drawings.

Figure 1:
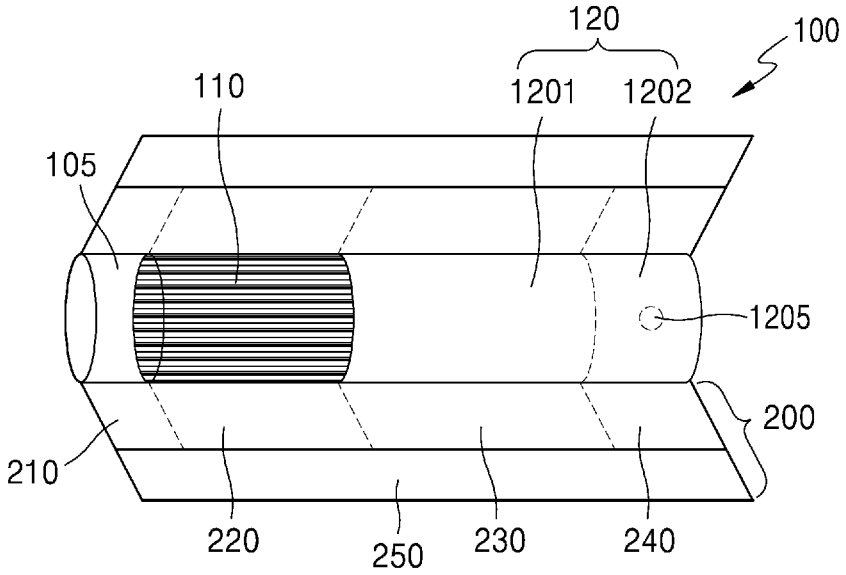
FIG. 1 is a view showing a cigarette according to the embodiment.

FIG. 1 is a view showing a cigarette 100 according to the embodiment.

Referring to FIG. 1, the cigarette 100 according to the embodiment includes a cigarette rod 110 including an aerosol-generating material, a filter rod 120 located at one end of the cigarette rod 110 and including a first segment 1201 and a second segment 1202, a front end plug 105 located at the other end of the cigarette rod 110, and an outer wrapper 250 wrapping the cigarette rod 110, the filter rod 120, and the front end plug 105, wherein the outer wrapper 250 has a basis weight of 57 g/m$^2$ to 63 g/m$^2$ and a thickness of 64 μm to 70 μm in order to increase strength of the cigarette 100.

A diameter of the cigarette 100 may be within a range of 5 mm to 9 mm, and a length of the cigarette 100 may be about 48 mm, but embodiments are not limited thereto. For example, the length of the cigarette rod 110 may be about 12 mm, the length of the first segment 1201 of the filter rod 120 may be about 10 mm, the length of the second segment of the filter rod 120 may be about 14 mm, and the length of the third segment of the filter rod 120 may be about 12 mm, but embodiments are not limited thereto.

The cigarette rod 110 may include the aerosol-generating material. For example, the aerosol-generating material may include at least one of glycerin, propylene glycol, ethylene glycol, dipropylene glycol, diethylene glycol, triethylene glycol, tetraethylene glycol, and oleyl alcohol, but it is not limited thereto.

In addition, the cigarette rod 110 may contain other additives such as flavors, wetting agents and/or organic acids. In addition, a flavoring liquid such as menthol or moisturizer may be added to the cigarette rod 110 by spraying the flavoring liquid onto the cigarette rod 110.

The cigarette rod 110 may be manufactured in various forms. For example, the cigarette rod 110 may be made of sheets or strands. In addition, the cigarette rod 110 may be made of shredded tobacco obtained by finely cutting a tobacco sheet. In addition, the cigarette rod 110 may be surrounded by a heat conducting material.

For example, the heat-conducting material surrounding the cigarette rod 110 may improve conductivity of heat applied to the cigarette rod 110 by evenly distributing heat transferred to the cigarette rod 110, thereby improving a taste of cigarettes. In addition, the heat-conducting material surrounding the cigarette rod 110 may function as a susceptor that is heated by an induction heating type heater. Herein, although not shown in the drawing, the cigarette rod 110 may further include an additional susceptor in addition to the heat conducting material surrounding the outside thereof.

The filter rod 120 may be located at one end of the cigarette rod 110, and the filter rod 120 may include one or more segments. Referring to FIG. 1, the filter rod 120 includes the first segment 1201 and the second segment 1202, but it is obvious to those skilled in the art that the number and shape of the filter rod 120 are not limited thereto, and may be changed as necessary.

For example, the filter rod 120 may include a segment that supports the cigarette rod 110, a segment that cools aerosol, or a segment that filters certain components contained in the aerosol. Further, if necessary, the filter rod 120 may further include segments that perform other functions.

The first segment 1201 may be made from cellulose acetate. For example, the first segment 1201 may be a tube-shaped structure including a hollow inside thereof.

The second segment 1202 may be made from cellulose acetate.

Also, at least one capsule 1205 may be included in the second segment 1202. Here, the capsule 1205 may generate flavor or the aerosol. For example, the capsule 1205 may have a structure in which a liquid containing a flavor is wrapped with a film. The capsule 1205 may have a spherical or cylindrical shape, but is not limited thereto.

The front end plug 105 may be located at the opposite end of the filter rod 120 positioned at one end of the cigarette rod 110 when the cigarette rod 110 is referenced. That is, when the filter rod 120 is located at one end of the cigarette rod 110, the front end plug 105 may be located at the other end of the cigarette rod 110. The front end plug 105 may prevent the cigarette rod 110 from escaping, and prevent liquefied aerosol from flowing from the cigarette rod 110 into the aerosol-generating device (1 in FIGS. 4 and 5) during smoking.

The front end plug 105 may made of cellulose acetate.

In addition, if necessary, the front end plug 105 may include at least one channel, and the cross-sectional shape of the channel may vary.

The cigarette 100 may include an outer wrapper 250 wrapping the cigarette rod 110, the filter rod 120, and the front end plug 105, and the outer wrapper 250 has a basis weight of 57 g/m$^2$ to 63 g/m$^2$ and a thickness of 64 μm to 70 μm in order to increase strength of the cigarette 100. For example, the basis weight of the outer wrapper 250 may be 60 g/m$^2$, and the thickness of the outer wrapper 250 may be 67 μm.

The outer wrapper 250 may have a tensile strength of 8.0 kgf/15 mm to 11.0 kgf/15 mm. For example, the outer wrapper 250 may have the tensile strength of 9.5 kgf/15 mm.

The outer wrapper 250 may be made of paper whose strength, water resistance, smoothness, etc., may have increased physical properties than ordinary paper. Accordingly, the cigarette 100 including the outer wrapper 250 may have the increased strength. Due to the high water resistance of the outer wrapper 250, resistance to the external liquid that may contact the cigarette 100 may be increased. Due to the high smoothness of the outer wrapper 250, printing on the outer wrapper 250 may be easy.

The outer wrapper 250 surrounds the cigarette 100 and forms the outermost surface of the cigarette 100, and may provide strength to maintain the shape of the cigarette 100. Herein, the strength of the cigarette 100 may be tensile strength to prevent damage and cutting by external force, and the strength of the cigarette 100 may be changed depending on the properties of the outer wrapper 250.

As the strength of the cigarette 100 is increased, it is possible to prevent the cigarette 100 from being damaged or wrinkled by stress and frictional forces that may occur when the cigarette 100 is inserted into the aerosol-generating device, in addition to user's gripping of the cigarette 100.

As the outer wrapper 250 forms an outermost surface of the cigarette 100, the shape of the cigarette 100 may be changed depending on the shape of the outer wrapper 250. Also, the outer wrapper 250 may easily print than an ordinary paper, because the outer wrapper 250 may have an increased smoothness than ordinary paper.

For example, letters, patterns, symbols, images, etc. may be printed on the outer wrapper 250. The characters, patterns, symbols, images, etc. printed on the outer wrapper 250 may be changed, such that the cigarette 100 may provide various visual information.

The user may check the properties of the cigarette 100, such as the flavor of the cigarette 100 or the ingredient ratio of the cigarette 100 by referring to letters, patterns, symbols, images, etc. printed on the outer wrapper 250, and thus may distinguish and select the cigarette 100. The outer wrapper 250 may include visual information such as printed characters, patterns, symbols, and images, and tactile information such as a thickness of the outer wrapper 250 and a diameter of the outer wrapper 250, but the shape of the outer wrapper 250 is not limited thereto.

The outer wrapper 250 may prevent the cigarette 100 from being burned. For example, when the cigarette rod 110 is heated, there is a possibility that the cigarette 100 is burned. Specifically, when the temperature rises equal to or greater than an ignition point of any one of the substances included in the cigarette rod 110, the cigarette 100 may be burned. However, since the outer wrapper 250 includes a non-combustible material, it is possible to prevent the cigarette 100 from being burned.

In addition, the outer wrapper 250 may prevent the outside of the cigarette 100 from being contaminated by substances generated in the cigarette 100. Liquid substances may be generated in the cigarette 100 by the user's puff. For example, the aerosol generated in the cigarette 100 is cooled by external air, and thereby liquid substances (e.g., moisture, etc.) may be generated. As the outer wrapper 250 wraps the cigarette 100, liquid substances generated in the cigarette 100 may be prevented from leaking out of the cigarette 100.

Figure 2:
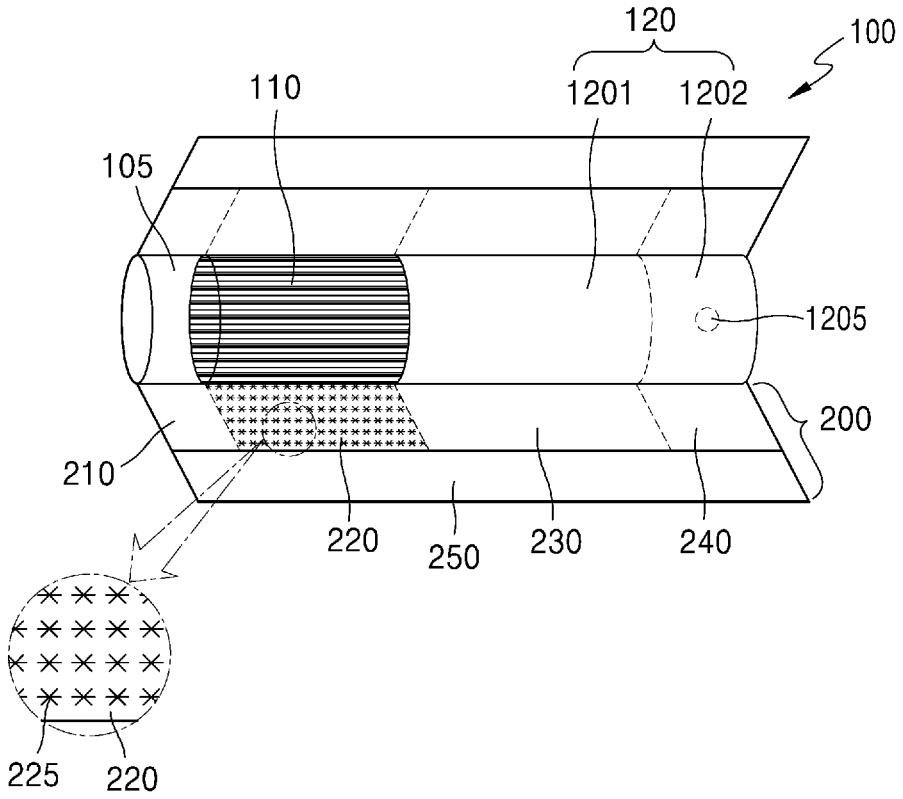
FIG. 2 is a view showing a cigarette according to another embodiment.

FIG. 2 is a view showing a cigarette 100 according to another embodiment of the present disclosure.

The cigarette 100 according to this embodiment may further include at least one of a first wrapper 210 wrapping a front end plug 105, a second wrapper 220 wrapping the cigarette rod 110, a third wrapper 230 wrapping the first segment 1201, and a fourth wrapper 240 wrapping the second segment 1202. The basis weight of the second wrapper 220 may be lower than the basis weight of the outer wrapper 250.

In addition, the porosity of the second wrapper 220 may be higher than that of the outer wrapper 250, and the porosity of the second wrapper 220 may be 20000 cu to 40000 cu.

A coating material 225 may be applied to at least one surface of an inner surface and an outer surface of the second wrapper 220 to improve a heat transfer rate for the heat that is transferred into the cigarette rod 110 through the second wrapper 220.

The coating material 225 to be applied to at least one of the inner surface and the outer surface of the second wrapper 220 may include at least one of sodium-citrate (Na-citrate) and potassium-citrate (K-citrate).

The cigarette 100 according to this embodiment may further include at least one of the first wrapper 210 to the fourth wrapper 240. For example, the front end plug 105 may be wrapped by the first wrapper 210, the cigarette rod 110 may be wrapped by the second wrapper 220, the first segment 1201 is wrapped by the third wrapper 230, and the second segment 1202 may be wrapped by the fourth wrapper 240.

In addition, the entire cigarette 100 may be rewrapped by the outer wrapper 250. As an example, a wrapper 200 may include the first wrapper 210, the second wrapper 220, the third wrapper 230, the fourth wrapper 240, and the outer wrapper 250, but is not limited to the example.

A basis weight of the first wrapper 210 may be in the range of 50 $g/m^2$ to 55 $g/m^2$, and preferably it may be 53 $g/m^2$.

The second wrapper 220 and the third wrapper 230 may be made of general filter wrapping paper. For example, the second wrapper 220 and the third wrapper 230 may be porous wrapping paper or non-porous wrapping paper.

For example, the porosity of the second wrapper 220 may be 35000 cu, but is not limited thereto. In addition, a thickness of the second wrapper 220 may be in the range of 65 μm to 80 μm, and preferably it may be 78 μm. In addition, the basis weight of the second wrapper 220 may be in the range of 19 $g/m^2$ to 25 $g/m^2$, and preferably it may be 23.5 $g/m^2$.

For example, a porosity of the third wrapper 230 may be 24000 cu, but is not limited thereto. In addition, a thickness of the third wrapper 230 may be in the range of 60 μm to 70 μm, and preferably it may be 68 μm. In addition, a basis weight of the third wrapper 230 may be included within a range of 20 $g/m^2$ to 25 $g/m^2$, and preferably it may be 21 $g/m^2$.

For example, a thickness of the fourth wrapper 240 may be in the range of 100 μm to 120 μm, and preferably it may be 110 μm. In addition, a basis weight of the fourth wrapper 240 may be included within a range of 80 $g/m^2$ to 100 $g/m^2$, and preferably it may be 88 $g/m^2$.

As the cigarette 100 includes at least one of the first wrapper 210 to the fourth wrapper 240 and the outer wrapper 250, the cigarette 100 may include a double wrapper. Accordingly, the strength provided by at least one wrapper of the first wrapper 210 to the fourth wrapper 240 and the strength provided by the outer wrapper 250 may be added to further increase the strength of the cigarette 100.

The basis weight of the second wrapper 220 may be lower than the basis weight of the outer wrapper 250, which means that the second wrapper 220 may be made of a thinner paper than the outer wrapper 250. The thermal conductivity of the second wrapper 220 made of thin paper may be higher than that of the outer wrapper 250. Accordingly, heat passing through the outer wrapper 250 may be smoothly transferred to the cigarette rod 110 under the second wrapper 220.

The porosity of the second wrapper 220 may be higher than the porosity of the outer wrapper 250. As the porosity of the second wrapper 220 is higher than that of the outer wrapper 250, heat which is generated from an external heat source of the cigarette 100 and passed through the external wrapper 250 may be prevented from being absorbed by the second wrapper 220. The heat transferred through the outer wrapper 250 may be easily passed through the second wrapper 220 and transferred into the cigarette rod 110 wrapped by the second wrapper 220.

As heat is easily transferred into the cigarette rod 110 through the outer wrapper 250 and the second wrapper 220, aerosol generated by heating the cigarette rod 110 may be generated more smoothly and abundantly. And then, the aerosol may be inhaled by the user through components inside the cigarette 100.

On the other hand, it is obvious to those skilled in the art that heat may be transferred to the cigarette rod 110 in the cigarette 100 through various paths in addition to the path including the outer wrapper 250 and the second wrapper 220 having a higher porosity than the outer wrapper 250.

The porosity of the second wrapper 220 may be 20000 cu to 40000 cu. For example, the porosity of the second wrapper 220 may be 35000 cu, which may be higher than the porosity of the outer wrapper 250. In addition, the second wrapper 220 may have the highest porosity among the wrappers. For example, the porosity of the second wrapper 220 may be higher than the porosity of the first wrapper 210, the third wrapper 230, and the fourth wrapper 240.

Examining the cigarette 100 according to another embodiment in more detail with reference to FIG. 2, the coating material 225 may be applied to the inner surface and/or the outer surface of the second wrapper 220 to improve the heat transfer rate for the heat transferred into the cigarette rod 110 through the second wrapper 220. The coating material 225 to be applied to the inner surface and/or the outer surface of the second wrapper 220 may include at least one of sodium-citrate (Na-citrate) and potassium-citrate (K-citrate).

In order for the cigarette 100 to produce the aerosol properly, it is necessary that heat is smoothly transferred into the cigarette rod 110 with a heat transfer rate equal to or greater than a predetermined range. In the case where the cigarette 100 according to an embodiment further includes a second wrapper 220, heat may be absorbed by the second wrapper 220 wrapping the cigarette rod 110. In this regard, it is necessary to prevent heat transfer to the cigarette rod 110 from being blocked by the second wrapper 220, thereby increasing the amount of heat transferred into the second wrapper 220.

In order to increase the heat transfer rate for the heat generated from the external heat source of the cigarette 100 and transferred to the second wrapper 220 after passing through the outer wrapper 250, the coating material 225 may be applied to the surface of the second wrapper 220. The surface coating material, which is a material that allows heat to flow into the cigarette rod 110 in the second wrapper 220 without being absorbed by the second wrapper 220, may be applied to at least one of the inner surface and the outer surface of the second wrapper 220.

That is, the coating material 225 may be applied to the outer surface facing the outer wrapper 250 or the inner surface facing a cigarette rod 110, or both the inner surface and the outer surface, among the surfaces of the second wrapper 220. It is obvious to those skilled in the art that the coating material 225 may be applied only to a part of the inner surface or a part of the outer surface, and that the size/area of the surface and the amount of the coating material may be modified as necessary.

The coating material 225 may include at least one of sodium-citrate (Na-citrate) and potassium-citrate (K-citrate). The above-described coating material 225 may serve to increase the efficiency of heat transfer to the cigarette rod 110 located inside the second wrapper 220.

Herein, the applied content of the coating material 225 may be 1% to 3%, but is not limited thereto, and the content value may be changed as necessary.

Figure 3:
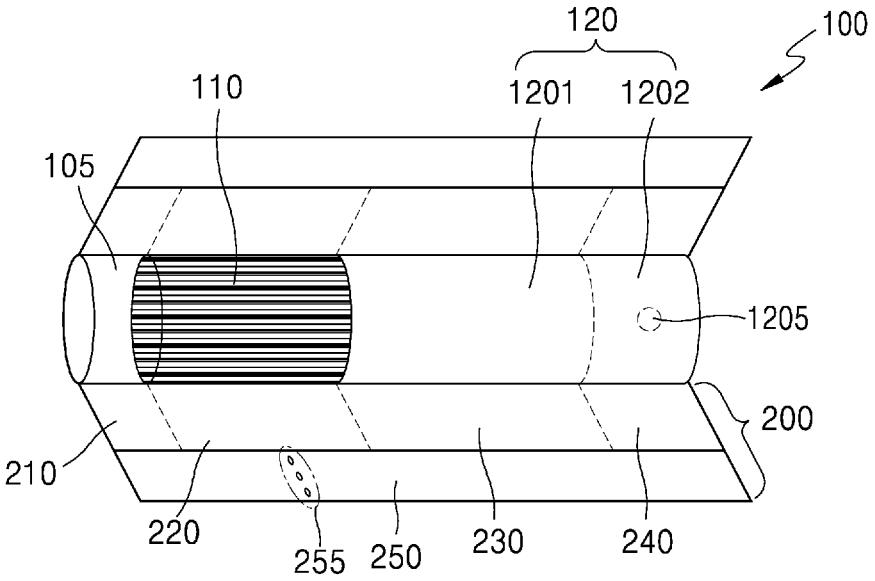
FIG. 3 is a view showing a cigarette according to yet another embodiment.

FIG. 3 is a view showing a cigarette according to yet another embodiment. Referring to FIG. 3, the cigarette 100 may include one or more holes 255 on the surface of the wrapper 200.

Figure 4:
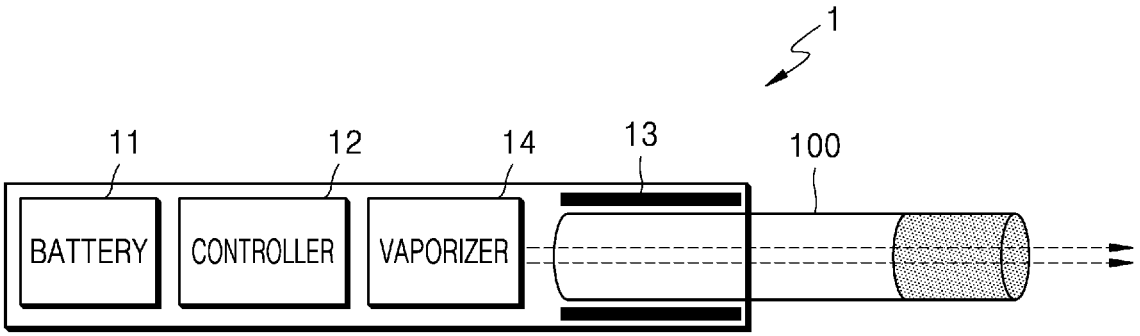
FIGS. 4 to 5 are diagrams showing examples in which a cigarette is inserted into the aerosol-generating device.
Figure 5:
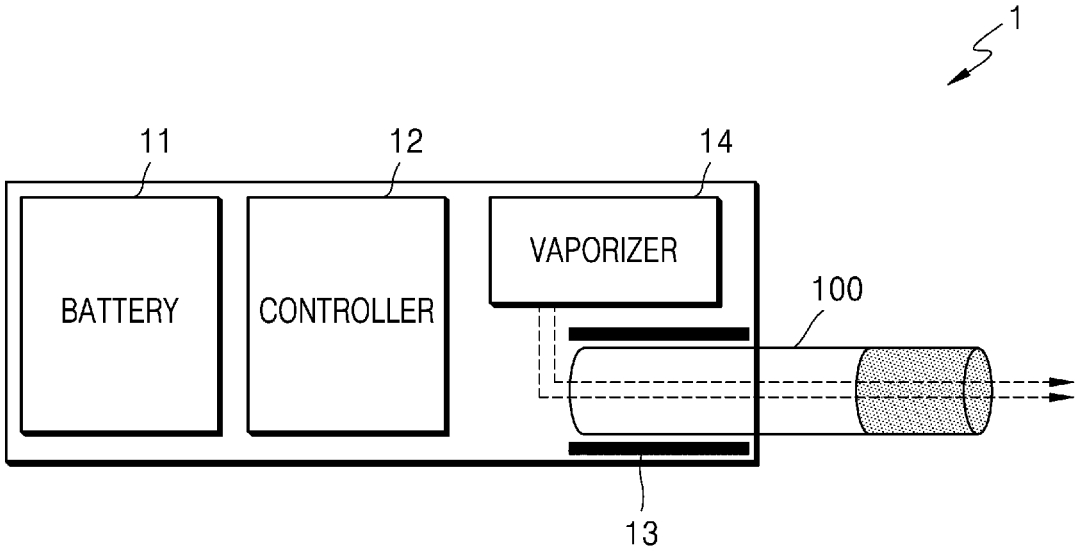

FIGS. 4 through 5 are diagrams showing examples in which a cigarette 100 is inserted into an aerosol generating device.

Referring to FIGS. 4 and 5, the aerosol generating device 1 may further include a vaporizer 14. Also, the cigarette 100 may be inserted into an inner space of the aerosol generating device 1.

FIGS. 4 through 5 illustrate components of the aerosol generating device 1, which are related to the present embodiment. Therefore, it will be understood by one of ordinary skill in the art related to the present embodiment that other general-purpose components may be further included in the aerosol generating device 1.

Also, FIGS. 4 and 5 illustrate that the aerosol generating device 1 includes the heater 13. However, according to necessity, the heater 13 may be omitted.

FIG. 4 illustrates that the battery 11, the controller 12, the vaporizer 14, and the heater 13 are arranged in series. Also, FIG. 5 illustrates that the vaporizer 14 and the heater 13 are arranged in parallel. However, the internal structure of the aerosol generating device 1 is not limited to the structures illustrated in FIGS. 4 through 5. In other words, according to the design of the aerosol generating device 1, the battery 11, the controller 12, the heater 13, and the vaporizer 14 may be differently arranged.

When the cigarette 100 is inserted into the aerosol generating device 1, the aerosol generating device 1 may operate the heater 13 and/or the vaporizer 14 to generate an aerosol from the cigarette 100 and/or the vaporizer 14. The aerosol generated by the heater 13 and/or the vaporizer 14 is delivered to a user by passing through the cigarette 100.

According to necessity, even when the cigarette 100 is not inserted into the aerosol generating device 1, the aerosol generating device 1 may heat the heater 13.

The battery 11 may supply power to be used for the aerosol generating device 1 to operate. For example, the battery 11 may supply power to heat the heater 13 or the vaporizer 14, and may supply power for operating the controller 12. Also, the battery 11 may supply power for operations of a display, a sensor, a motor, etc. mounted in the aerosol generating device 1.

The controller 12 may generally control operations of the aerosol generating device 1. In detail, the controller 12 may control not only operations of the battery 11, the heater 13, and the vaporizer 14, but also operations of other components included in the aerosol generating device 1. Also, the controller 12 may check a state of each of the components of the aerosol generating device 1 to determine whether or not the aerosol generating device 1 is able to operate.

The controller 12 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13 may be heated by the power supplied from the battery 11. For example, when the cigarette 100 is inserted into the aerosol generating device 1, the heater 13 may be located outside the cigarette 100. Thus, the heated heater 13 may increase a temperature of an aerosol generating material in the cigarette 100.

The heater 13 may include an electro-resistive heater. For example, the heater 13 may include an electrically conductive track, and the heater 13 may be heated when currents flow through the electrically conductive track. However, the heater 13 is not limited to the example described above and may include all heaters which may be heated to a desired temperature. Here, the desired temperature may be pre-set in the aerosol generating device 1 or may be set as a temperature desired by a user.

As another example, the heater 13 may include an induction heater. In detail, the heater 13 may include an electrically conductive coil for heating a cigarette in an induction heating method, and the cigarette may include a susceptor which may be heated by the induction heater.

For example, the heater 13 may include a tube-type heating element, a plate-type heating element, a needle-type heating element, or a rod-type heating element, and may heat the inside or the outside of the cigarette 100, according to the shape of the heating element.

Also, the aerosol generating device 1 may include a plurality of heaters 13. Here, the plurality of heaters 13 may be inserted into the cigarette 100 or may be arranged outside the cigarette 100. Also, some of the plurality of heaters 13 may be inserted into the cigarette 100 and the others may be arranged outside the cigarette 100. In addition, the shape of the heater 13 is not limited to the shapes illustrated in FIGS. 4 through 5 and may include various shapes.

The vaporizer 14 may generate an aerosol by heating a liquid composition and the generated aerosol may pass through the cigarette 100 to be delivered to a user. In other words, the aerosol generated via the vaporizer 14 may move along an air flow passage of the aerosol generating device 1 and the air flow passage may be configured such that the aerosol generated via the vaporizer 14 passes through the cigarette 100 to be delivered to the user.

For example, the vaporizer 14 may include a liquid storage, a liquid delivery element, and a heating element, but it is not limited thereto. For example, the liquid storage, the liquid delivery element, and the heating element may be included in the aerosol generating device 1 as independent modules.

The liquid storage may store a liquid composition. For example, the liquid composition may be a liquid including a tobacco-containing material having a volatile tobacco flavor component, or a liquid including a non-tobacco material. The liquid storage may be formed to be attached/detached to/from the vaporizer 14 or may be formed integrally with the vaporizer 14.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned by being wound around the liquid delivery element. The heating element may be heated by a current supply and may transfer heat to the liquid composition in contact with the heating element, thereby heating the liquid composition. As a result, an aerosol may be generated.

For example, the vaporizer 14 may be referred to as a cartomizer or an atomizer, but it is not limited thereto.

The aerosol generating device 1 may further include general-purpose components in addition to the battery 11, the controller 12, the heater 13, and the vaporizer 14. For example, the aerosol generating device 1 may include a display capable of outputting visual information and/or a motor for outputting haptic information. Also, the aerosol generating device 1 may be formed as a structure where, even when the cigarette 100 is inserted into the aerosol generating device 1, external air may be introduced or internal air may be discharged.

Although not illustrated in FIGS. 4 through 5, the aerosol generating device 1 and an additional cradle may form together a system. For example, the cradle may be used to charge the battery 11 of the aerosol generating device 1. Alternatively, the heater 13 may be heated when the cradle and the aerosol generating device 1 are coupled to each other.

The cigarette 100 may be similar as a general combustive cigarette. For example, the cigarette 100 may be divided into a first portion including an aerosol generating material and a second portion including a filter, etc. Alternatively, the second portion of the cigarette 100 may also include an aerosol generating material. For example, an aerosol generating material made in the form of granules or capsules may be inserted into the second portion.

The entire first portion may be inserted into the aerosol generating device 1, and the second portion may be exposed to the outside. Alternatively, only a portion of the first portion may be inserted into the aerosol generating device 1, or the entire first portion and a portion of the second portion may be inserted into the aerosol generating device 1. The user may puff the aerosol while holding the second portion in his or her mouth. In this case, the aerosol is generated by the external air passing through the first portion, and the generated aerosol passes through the second portion and is delivered to the user's mouth.

For example, the external air may flow into at least one air passage formed in the aerosol generating device 1. For example, the opening and closing and/or a size of the air passage formed in the aerosol generating device 1 may be adjusted by the user. Accordingly, the amount of smoke and smoking sensation may be adjusted by the user. As another example, the external air may flow into the cigarette 100 through at least one hole 255 (see FIG. 3) formed in a surface of the cigarette 100.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

What is claimed is:

1. A cigarette comprising:

a cigarette rod including an aerosol-generating material;

a filter rod located at one end of the cigarette rod and including a first segment and a second segment;

a front end plug located at another end of the cigarette rod; and an outer wrapper wrapping the cigarette rod, the filter rod and the front end plug, wherein the outer wrapper has a basis weight of 57 $g/m^2$ to 63 $g/m^2$ and a thickness of 64 μm to 70 μm to increase strength of the cigarette.

2. The cigarette of claim 1, wherein the outer wrapper has a tensile strength of 8.0 kgf/15 mm to 11.0 kgf/15 mm.

3. The cigarette of claim 1, further comprising at least one of a first wrapper wrapping the front end plug, a second wrapper wrapping the cigarette rod, a third wrapper wrapping the first segment, and a fourth wrapper wrapping the second segment, wherein a basis weight of the second wrapper is lower than a basis weight of the outer wrapper.

4. The cigarette of claim 3, wherein porosity of the second wrapper is higher than porosity of the outer wrapper.

5. The cigarette of claim 3, wherein porosity of the second wrapper is 20000 cu to 40000 cu.

6. The cigarette of claim 3, wherein a coating material is applied to at least one of an inner surface and an outer surface of the second wrapper such that a rate of heat transfer to the cigarette rod through the second wrapper is improved.

7. The cigarette of claim 6, wherein the coating material includes at least one of sodium-citrate (Na-citrate) and potassium-citrate (K-citrate).

* * * * *